US010371380B2

(12) United States Patent
Liao

(10) Patent No.: US 10,371,380 B2
(45) Date of Patent: Aug. 6, 2019

(54) IGNITER WITH SAFETY PROTECTION DEVICE AND IGNITION CONTROL METHOD THEREFOR

(71) Applicant: WENZHOU UNICLEVER GIFT INNOVATION CO., LTD, Wenzhou, Zhejiang (CN)

(72) Inventor: Jinli Liao, Shanghai (CN)

(73) Assignee: WENZHOU UNICLEVER GIFT INNOVATION CO., LTD, Wenzhou, Zhejiang (CN)

( * ) Notice: Subject to any disclaimer, the term of this patent is extended or adjusted under 35 U.S.C. 154(b) by 194 days.

(21) Appl. No.: 15/545,587

(22) PCT Filed: Jan. 20, 2016

(86) PCT No.: PCT/CN2016/071478
§ 371 (c)(1),
(2) Date: Jul. 21, 2017

(87) PCT Pub. No.: WO2016/116049
PCT Pub. Date: Jul. 28, 2016

(65) Prior Publication Data

US 2018/0094810 A1 Apr. 5, 2018

(30) Foreign Application Priority Data

Jan. 21, 2015 (CN) ..... 2015 1 0031229

(51) Int. Cl.
*F23Q 2/16* (2006.01)
*F23Q 2/32* (2006.01)
(Continued)

(52) U.S. Cl.
CPC ..... *F23Q 2/164* (2013.01); *F23Q 2/287* (2013.01); *F23Q 2/32* (2013.01); *F23Q 7/24* (2013.01); *F23Q 2/173* (2013.01); *F23Q 2/34* (2013.01)

(58) Field of Classification Search
CPC . F23Q 2/164; F23Q 2/287; F23Q 2/32; F23Q 7/24; F23Q 2/34; F23Q 2/173
See application file for complete search history.

(56) References Cited

U.S. PATENT DOCUMENTS 6,390,809 B1 * 5/2002 Gerace ..... F23Q 2/164 431/153
2009/0263754 A1 10/2009 Wang
2015/0024355 A1 * 1/2015 Ghofrani ..... A24F 47/00 434/236

FOREIGN PATENT DOCUMENTS

CN 2332912 Y 8/1999
CN 101059246 A 10/2007
(Continued)

OTHER PUBLICATIONS

International Search Report (English and Chinese) and Written Opinion of International Application No. PCT/CN2016/071478, dated Apr. 18, 2016, 9 pages provided.

*Primary Examiner* — Daniel J Cavallari
(74) *Attorney, Agent, or Firm* — Hamre, Schumann, Mueller & Larson, P.C.

(57) ABSTRACT

An igniter with a safety protection device (5) and an ignition control method therefor. The igniter comprises an ignition switch (3) and an energy supply module (4). The safety protection device (5) comprises a safety switch (51), a trigger module (52) and a wireless transceiver module (53), wherein the wireless transceiver module (53) can transmit a wireless request signal, receive a wireless response signal from an external device (2) and transmit the received wire-
(Continued)

less response signal to the trigger module (52), and the trigger module (52) triggers the safety switch (51) according to the wireless response signal to enable the safety switch (51) to act, so that ignition can be realized, and the ignition cannot be realized even the ignition switch (3) is actuated when the wireless transceiver module (53) does not receive the wireless response signal. The igniter can effectively prevent children or disabled persons from accidentally using the igniter.

18 Claims, 11 Drawing Sheets

(51) Int. Cl.

| | |
|---|---|
| ***F23Q 7/24*** | (2006.01) |
| ***F23Q 2/28*** | (2006.01) |
| *F23Q 2/173* | (2006.01) |
| *F23Q 2/34* | (2006.01) |

(56) References Cited

FOREIGN PATENT DOCUMENTS

| | | | |
|---|---|---|---|
| CN | 100404959 | C | 7/2008 |
| CN | 101290140 | A | 10/2008 |
| CN | 103742941 | A | 4/2014 |
| CN | 204063121 | U | 12/2014 |
| CN | 204085324 | U | 1/2015 |
| DE | 202011001310 | U1 | 8/2011 |
| JP | H11257658 | A | 9/1999 |

* cited by examiner

IGNITER WITH SAFETY PROTECTION DEVICE AND IGNITION CONTROL METHOD THEREFOR

FIELD OF THE INVENTION

The invention relates to an igniter, in particular to a lighter and a burning torch with a safety protection device.

BACKGROUND OF THE INVENTION

The ignition (heating) triggering device of a traditional lighter or a burning torch is integrated with the product, so that a huge potential safety hazard can be generated if an user is improper in operation, and especially for children. The fire and casualty accidents caused by the children in the world are often happened due to the fact that children play the lighter all over the world. About 40 children in the Europe only are dead each year due to fire disasters caused by improper use of lighters. A device used for preventing children from igniting the lighter should be provided inside lighters sold in the developed countries, such as United States, Canada, Europe, Australia, New Zealand and Japan, according to the laws of these countries, so as to avoid personnel and property loss caused by accidental use of the lighter by children or mentally handicapped and guarantee the safety of consumers. At present, more and more countries are conducting legislation in related aspects. For example, US has CPSC (Consumer Products Safety Commission) regulations since 1994, Canada has Health Canada regulations since 2007, Europe has CR (Child Resistant) regulations since 2006 and Japan has PSC (Product Safety Commission) regulations since 2011.

At present, the lighter safety protection devices are mainly weighting electronic triggering (greater than 8 pounds of pressing force) and multi-action triggering devices. However, the safety lock is additionally arranged, so that the cost of the production is increased, and the use of the lighter is very inconvenient.

SUMMARY OF THE INVENTION

The invention aims to provide a lighter or a burning torch which is convenient to use and has an anti-child safety protection device.

In order to achieve the aim, the invention provides a lighter with a safety protection device, wherein the lighter comprises an ignition switch and an energy supply module, wherein the safety protection device comprises a safety switch, a trigger module and a wireless transceiver module, wherein the wireless transceiver module is capable of transmitting a wireless request signal, receiving a wireless response signal from an external device and transmitting the received wireless response signal to the trigger module, wherein the trigger module triggers the safety switch according to the wireless response signal to enable the safety switch to act so that ignition can be realized, and the ignition cannot be realized even the ignition switch is actuated when the wireless transceiver module does not receive the wireless response signal.

Preferably, when the wireless transceiver module does not receive the wireless response signal, the safety switch does not act.

Preferably, when the external device is within a communication range with the lighter, the ignition switch is actuated, and the trigger module and the wireless module work, so that the safety switch is switched on to achieve ignition Preferably, the external device is a mobile terminal with a wireless transceiver, and the wireless transceiver is capable of receiving the wireless request signal and sending the wireless response signal according to the wireless request signal.

Preferably, the mobile terminal is a mobile phone, a tablet computer or wearable device.

Preferably, the lighter is provided with an auxiliary battery, and the auxiliary battery supplies power to the safety protection device.

Preferably, the wireless transceiver module comprises a bluetooth transceiver, Wifi, Lifi, a zigbee or an infrared transceiver.

In one embodiment, the lighter further comprises a grinding wheel and a flint; the energy supply module is provided with a gas tank used for containing liquefied fuel; the safety switch is a valve arranged at the outlet of the gas tank and is used for opening or closing the gas tank, wherein the trigger module is in communication with the wireless transceiver module and is electrically connected with the safety switch, wherein the trigger module is capable of processing signals from the wireless transceiver module and sending the processed signals to the valve to open the valve.

Preferably, the trigger module is an integrated circuit. Herein, the integrated circuit may adopt a circuit which is commonly used in the field and can achieve the functions.

Preferably, the valve is an solenoid valve.

In another embodiment, the lighter further comprises a piezoelectric voltage generating device, and the energy supply module is provided with a gas tank used for containing the liquefied fuel, wherein the piezoelectric voltage generating device is electrically connected with the safety switch, wherein the trigger module is in communication with the wireless transceiver module and is electrically connected with the safety switch, wherein the trigger module processes signals from the wireless transceiver module and sends the processed signals to the safety switch to enable the safety switch to be switched on, and further enables the piezoelectric voltage generating device to work.

Preferably, the safety switch is a triode, a controllable air switch or a microswitch.

Preferably, the trigger module is an integrated circuit (IC), and the base electrode of the triode is controlled through the IC to control communication between the emitter and the collector, and then the electrification and disconnection of the piezoelectric voltage generating device are controlled. Herein, the integrated circuit can adopt a circuit which is commonly used in the field and can achieve the functions.

In another embodiment, the energy supply module is a battery, and the battery is electrically connected with the heating wire via the safety switch, wherein the trigger module is in communication with the wireless transceiver module and is electrically connected with the safety switch, wherein the trigger module is capable of processing signals from the wireless transceiver module and sending the processed signals to the safety switch to enable the battery to be connected with or disconnected from the heating wire.

In another embodiment, the lighter can comprise a grinding wheel, a wick and a flint, and the energy supply module is provided with a liquid fuel containing chamber, wherein one end of the wick extends into the liquid fuel containing chamber, wherein the trigger module is in communication with the wireless transceiver module and is electrically connected with the safety switch, wherein the trigger module is capable of processing signals from the wireless transceiver module and sending the processed signals to the safety switch so as to lock or unlock the flint, wherein, in an unlocked state, when the grinding wheel is operated, a spark will be generated such that the ignition is realized, and in the locked state, the ignition can not be realized even when the grinding wheel is operated.

In the above embodiment, preferably, the safety switch comprises an electromagnet, a jumping rod and a locking member, wherein the jumping rod is connected with the locking member, and the locking member is detachably connected to the flint, wherein when the wireless transceiver module receives a wireless response signal from the external device, the jumping rod is actuated by the electromagnet and the locking member is driven to move, so that the flint is unlocked and is in contact with the grinding wheel.

The invention further provides an ignition control method of a lighter. The lighter comprises an ignition switch and an energy supply module, and the control method comprises the following steps:

closing the ignition switch;

sending a wireless request signal to an external device by the lighter;

the external device receiving the wireless request signals and sending out a wireless response signal;

the lighter receiving the wireless response signal and being triggered to work;

the ignition switch being switched off automatically after a preset period or being switched off manually.

Preferably, the method comprises a step of arranging a safety switch, a trigger module and a wireless transceiver module in the lighter, wherein the wireless transceiver module is capable of transmitting a wireless request signal, receiving a wireless response signal from the external device and transmitting the received wireless response signal to the trigger module, wherein the trigger module triggers the safety switch to enable the safety switch to act according to the wireless response signal, so that the ignition switch is capable of achieving ignition, and when the wireless transceiver module does not receive the wireless response signal, the safety switch does not act, and ignition can not be realized even if the ignition switch is actuated.

Preferably, the external device is a mobile terminal with a wireless transceiver, and the wireless transceiver is capable of receiving the wireless request signal and sending the wireless response signal according to the wireless request signal.

Preferably, the mobile terminal is a mobile phone, a tablet computer or a wearable device.

In one embodiment, the ignition control method comprises the following steps:

downloading and installing an APP in the external device;

communicating the lighter with the external device;

clicking the menu of the APP and clicking a cigarette lighter button;

the lighter receiving a signal sent by the external device and being triggered the lighter, so that the lighter is in a state capable of being ignited and the lighter is automatically switched off after the preset period.

In another embodiment, the ignition control method comprises the following steps:

downloading and installing an APP in the external device;

arranging a gyroscope module in the lighter;

rocking and shaking the lighter so as to communicate the lighter with the external device when smoking, and the external device triggering the lighter to work through the APP after receiving a shaking signal of the lighter.

According to the further aspect of the invention, a burning torch is provided. The burning torch comprises a body, a gas tank, a gas outlet pipe and an ignition port, wherein the gas tank is contained in the body and is used for containing fuel gas, and the gas outlet pipe is used for discharging the fuel gas from the gas tank, wherein the ignition port is located at the distal end of the gas outlet pipe. The burning torch is further provided with a safety protection device. The safety protection device comprises a first safety switch, a trigger module and a wireless transceiver module, wherein the wireless transceiver module is in communication with an external device, and the wireless transceiver module is electrically connected with the trigger module, wherein the trigger module is electrically connected with the first safety switch and is used for controlling the operation of the first safety switch, so that normal ignition is realized or accidental ignition is prevented.

In one embodiment, the burning torch comprises an electronic clip, wherein the electronic clip can be pressed to realize ignition when an external device is detected by the wireless transceiver module (such as bluetooth)) and an instruction of the external device is received. The ignition can not be realized even if the electronic clip is pressed when no external device is detected by the wireless transceiver module (such as bluetooth). Alternatively, the burning torch can be configured to achieve ignition when the electronic clip is pressed and held for a predetermined period of time, and the wireless transceiver module detects the external device and receives an instruction from the external device.

In one embodiment, the wireless transceiver module, the triggering device, the first safety switch and the external device are arranged so that the wireless transceiver module is capable of sending a wireless request signal, receiving a wireless response signal from the external device, and transmitting the received wireless response signals to the trigger module, wherein the trigger module triggers the first safety switch according to the wireless response signal to enable the first safety switch to act so as to realize ignition, and the ignition can not be realized even if the electronic clip is actuated when the wireless transceiver module does not receive the wireless response signal.

In one embodiment, the trigger module is electrically connected with the first safety switch and is used for controlling the operation of the first safety switch, so that normal ignition is realized or accidental ignition is prevented.

In one embodiment, the external device is a mobile terminal with a wireless transceiver, and the wireless transceiver is capable of receiving the wireless request signal and sending the wireless response signal according to the wireless request signal.

In one embodiment, the mobile terminal is a mobile phone, a tablet computer or wearable device.

In one embodiment, the wireless transceiver module comprises a bluetooth transceiver, a Wifi, a Lifi, a zigbee or an infrared transceiver.

In one embodiment, the burning torch further comprises an electronic clip and a piezoelectric voltage generating device, wherein the piezoelectric voltage generating device is used for igniting fuel gas, and the electronic clip is associated with the piezoelectric voltage generating device and the safety protection device, wherein the electronic clip is used for driving the piezoelectric voltage generating device and is further used for controlling the wireless transceiver module to be in communication with the external device.

In one embodiment, the burning torch further comprises a second safety switch, wherein the second safety switch is arranged on the body, and the second safety switch is connected with the electronic clip and is used for controlling the motion of the electronic clip.

In one embodiment, the first safety switch is a valve, wherein the valve is connected with the gas outlet pipe in series and is used for controlling the gas outlet pipe to be opened or closed, so as to allow gas to lead to the ignition port or block fuel gas from leading to the ignition port. Preferably, the valve is an solenoid valve.

In one embodiment, the burning torch further comprises a gas releasing mechanism, wherein the two ends of the piezoelectric voltage generating device are respectively connected to one end of the electronic clip and one end of the gas releasing mechanism, and the other end of the gas releasing mechanism is connected to the jumping rod.

In one embodiment, the first safety switch is connected to the gas outlet pipe in series and is used for controlling the gas outlet pipe to be opened or closed, so as to allow gas to lead to the ignition port or block fuel gas from leading to the ignition port.

Preferably, the first safety switch is an solenoid valve, and the solenoid valve is connected to the gas outlet pipe in series.

In one embodiment, the gas outlet pipe is composed of a first section of the gas outlet pipe and a second section of the gas outlet pipe, wherein the first section of the gas outlet pipe and the second section of the gas outlet pipe are connected through the first safety switch, and the first safety switch is used for controlling communication or blocking between the first section of the gas outlet pipe and the second section of the gas outlet pipe.

In one embodiment, the burning torch comprises a jumping rod, wherein one end of the jumping rod is connected with an gas outlet of the gas tank, wherein the first safety switch is associated with the jumping rod and is used for controlling the jumping rod to be switched between a first position and a second position, wherein at the first position, the electronic clip is capable of driving the jumping rod, and at the second position, the jumping rod cannot drive the jumping rod.

According to another aspect of the invention, a burning torch is provided. The burning torch comprises a body, an electronic clip, a piezoelectric voltage generating device, an gas tank, an gas outlet pipe and an ignition port, wherein the gas tank is contained in the body and is used for containing fuel gas, and the gas outlet pipe is used for discharging gas from the gas tank, wherein the ignition port is located at the distal end of the gas outlet pipe, the piezoelectric voltage generating device being used for igniting the fuel gas, and the electronic clip being used for driving the piezoelectric voltage generating device. The burning torch further comprises a data acquisition module and a wireless transceiver module, wherein the data acquisition module is used for acquiring ignition data of the burning torch and is electrically connected with the wireless transceiver module, wherein the wireless transceiver module is in communication with external device so as to transmit the ignition data to the external device.

In one embodiment, the ignition data comprises ignition times, ignition sites, ignition time and the like.

In one embodiment, the electronic clip is associated with the data acquisition module, so that the operation of the electronic clip is capable of controlling the data acquisition module to work so as to complete data acquisition of the ignition data.

In one embodiment, the wireless transceiver module comprises a bluetooth transceiver, a Wifi, a Lifi, a zigbee or an infrared transceiver.

According to a further aspect of the invention, an ignition control method of the burning torch is provided. The burning torch comprises a body, a gas tank, a gas outlet pipe and an ignition port, wherein the gas tank is contained in the body and is used for containing fuel gas, and the gas outlet pipe is used for discharging gas from the gas tank, wherein the ignition port is located at the distal end of the gas outlet pipe, wherein the ignition control method comprises the following step S1: judging whether the burning torch is in communication with an external device, and forbidding ignition of the burning torch if the burning torch is not in communication with the external device, and if the burning torch is in communication with the external device, the burning torch is directly ignited or the burning torch determines whether ignition is allowed according to an instruction from the external device.

In one embodiment, the burning torch further comprises a first safety switch, wherein the step S1 comprises the following steps:

S11: enabling the burning torch to send a wireless request signal to the external device;

S12: the external device receiving the wireless request signal and sending a wireless response signal;

S13: the burning torch receiving the wireless response signal; and

S14: the burning torch judging whether the received wireless response signal is a signal allowing ignition, and if the signal is a signal allowing ignition, the first safety switch is switched on and ignition is realized; if the signal is not a signal allowing ignition, the ignition is prohibited.

In one embodiment, the burning torch further comprises an electronic clip, wherein in the step S1, the electronic clip is driven to enable the burning torch to send a wireless request signal to the external device and receive a wireless response signal from the external device.

In one embodiment, the external device is installed with an APP for controlling the communication of the external device with the burning torch, wherein, step S1 comprises starting the APP before the step S11.

In one embodiment, the burning torch is configured such that when the burning torch is located beyond a preset distance from the external device or the APP stops running, the burning torch cannot realize ignition.

In one embodiment, the external device is a mobile terminal with a wireless transceiver, wherein the wireless transceiver is capable of receiving the wireless request signal and sending the wireless response signal according to the wireless request signal.

In one embodiment, the mobile terminal is a mobile phone, a tablet computer or wearable device.

The lighter and the burning torch of present invention controls wirelessly the lighting (heating) of a cigarette lighting, wherein the heating device can be separated from the trigger such that triggering operation requires a certain cognitive ability. The lighter will not be easily controlled by children and by persons who do not understand the potential hazard of fire, but can be conveniently used by adults. Therefore, it is a novel anti-child-using concept device. The safety of the product is improved, and the use of it by people is facilitated.

The igniter provided with a safety protection device with a wireless triggering means together with locking means and the ignition control method provides smokers with a cigarette lighting method which is advanced and safe. Further, the lighter may not be limited by aviation restriction.

DETAILED DESCRIPTION

Figure 1:
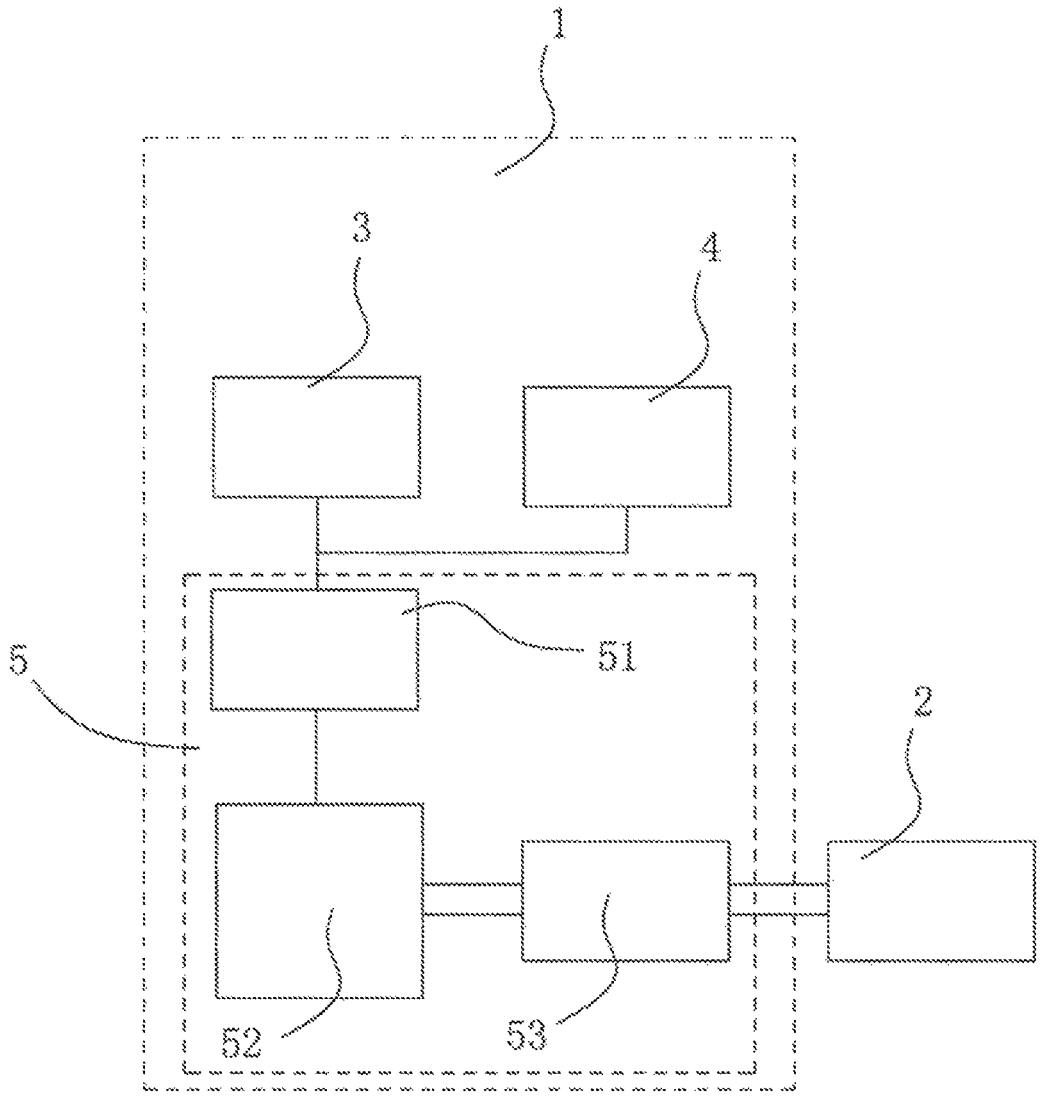
FIG. 1 is a schematic diagram of a lighter of the present invention.

Preferred embodiments of the present invention will be described in detail with reference to the drawings, so that the purposes, the characteristics and the advantages of the invention can be more clearly understood. It should be understood that the embodiments shown in the drawings are not intended to limit the scope of the invention, but for describing the essential spirit of the technical scheme of the invention.

FIG. 1 is a schematic diagram of a lighter 1 with an anti-child safety protection device of present invention. The main principle of the lighter achieving the anti-child safety protection function is a split-type safety protection device, namely, the lighter is triggered to work through another external device 2 except the lighter 1, so that safety protection is realized. In other words, ignition cannot be triggered if the lighter 1 does not receive an instruction or signal from the external device 2. The lighter can be triggered to realize ignition only when the lighter itself sends out a request signal and receives a response signal from the external device, so that the safety protection function is realized.

Specifically, as shown in FIG. 1, the lighter 1 comprises an ignition switch 3, an energy supply module 4, and a safety protection device 5, wherein the safety protection device 5 comprises a safety switch 51, a trigger module 52 and a wireless transceiver module 53, wherein the wireless transceiver module 53 can sent a wireless request signal after actuating the ignition switch 3 and can receive a wireless response signal from an external device and transmit the received wireless response signal to the trigger module 52. The trigger module 52 triggers the safety switch 51 to enable the safety switch to actuate according to the wireless response signal so as to realize ignition. When the wireless transceiver module 53 does not receive the wireless response signal, the safety switch 51 may not be actuated, and the lighter cannot be ignited even if the ignition switch 3 is actuated.

One of working modes of the lighter is as follows: the ignition switch is turned on; the wireless transceiver module sends a wireless request signal; the external device receives the wireless request signal and returns a wireless response signal (which can be a signal which permits a cigarette to be lighted or forbidden a cigarette to be lighted); when the wireless response signal received by the wireless transceiver module is a wireless response signal permitting a cigarette to be lighted, the wireless response signal is transmitted to the trigger module, and the trigger module triggers the safety switch to actuate according to the signal, and therefore ignition can be realized. In one embodiment, the lighter can be automatically ignited after receiving the wireless response signal, so that the ignition can be realized without pressing or pulling down a key of the lighter all the time. Alternatively, the ignition of the lighter can be realized by driving a grinding wheel and the like after receiving a wireless response signal.

Herein, the external device can be a mobile terminal with a wireless transceiver. The wireless transceiver can receive a wireless request signal and send a wireless response signal according to the wireless request signal. Preferably, the mobile terminal is a mobile phone, a tablet computer or a wearable device. The wearable device is, for example, a smart watch, a smart glasses or a smart bracelet.

The trigger module can be an integrated circuit or an electronic device capable of controlling the safety switch.

Preferably, the lighter is provided with an auxiliary battery and is used for supplying power to the safety protection device. The safety switch can be electrically connected with the auxiliary battery, so that when the trigger module does not receive a signal from the external device, the safety switch is disconnected, so that the auxiliary battery is disconnected with the safety protection device, and the lighter cannot be ignited.

Preferably, the wireless transceiver module comprises a bluetooth transceiver, a Wifi, a Lifi or an infrared transceiver and the like.

Preferably, the lighter further comprises a temperature sensor which is used for detecting the environment temperature. When the environment temperature exceeds a preset threshold, the energy supply module is cut off.

Herein, the lighter comprises various types of portable or desktop lighters used for igniting cigarettes, tobacco, barbecue ovens or fireplace. The types of the lighter comprise a rechargeable electric heating wire lighter, a gas piezoelectric voltage type lighter, a gas grinding wheel lighter, an wick grinding wheel lighter and other types of lighters.

Embodiment 1

Figure 2:
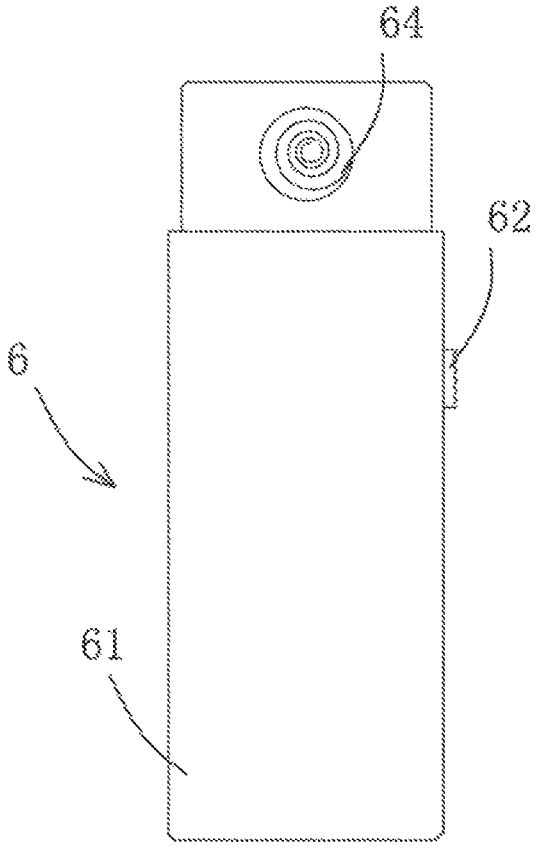
FIG. 2 is a schematic front view of a lighter according to a first embodiment of the present invention.
Figure 3:
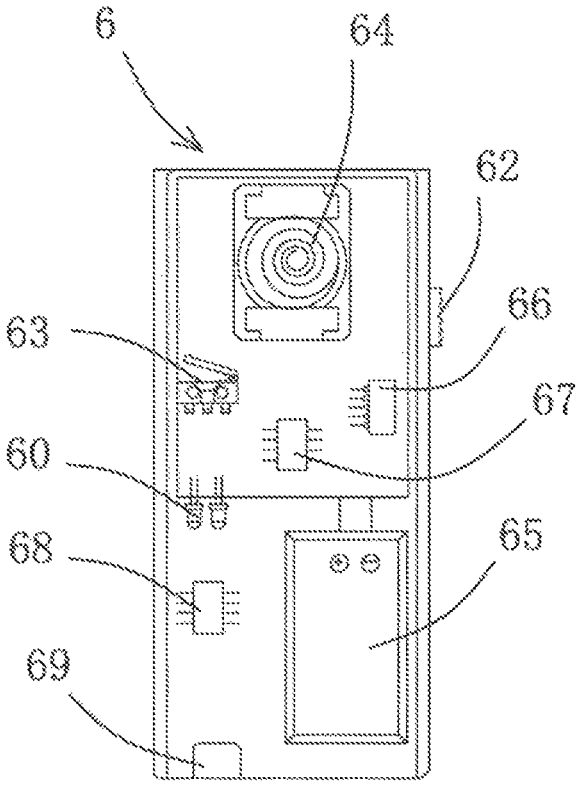
FIG. 3 is a schematic diagram showing an internal structure of the lighter of FIG. 2.

FIG. 2 and FIG. 3 show schematic structural diagrams of the lighter 6 according to the first embodiment of the present invention. The lighter 6 is a rechargeable electric heating wire lighter. As shown in FIGS. 2 and 3, the lighter 6 comprises a shell 61, a key 62, an ignition switch 63, a heating wire 64, a battery 65, a trigger module 66, a safety switch 67 and a wireless transceiver module 68, wherein the safety switch 67 and the wireless transceiver module 68 form the safety protection device. The ignition switch 63 is connected to the key 62 so that when the key 62 is operated (push-pulled or pressed), the ignition switch 63 can be opened or closed, respectively. The battery 65 is electrically connected with the heating wire 64 via the safety switch 67. The trigger module 66 is in communication with the wireless transceiver module 68 and is electrically connected with the safety switch 67. The trigger module 66 can process signals from the wireless transceiver module 68 and send the processed signals to the safety switch 67 to enable the battery 65 to be connected with or disconnected from the heating wire 64.

Herein, the wireless transceiver module 68 may employ any suitable electronic element or integrated circuit capable of transmitting and receiving signals, such as a bluetooth transceiver, a WIFI, a Lifi, a zigbee or an infrared transceiver. Preferably, the wireless transceiver module 68 can further process the signals.

Herein, the trigger module 66 can adopt any suitable electronic or mechanical device capable of controlling the safety switch.

In the embodiment, the lighter 6 further comprises a charging port 69 and an indicator light 60 which are used for charging the battery and indicating the electric quantity of the battery respectively.

During operation, the key 62 is pushed (and can also be pulled down or pressed down in other embodiments) so that the ignition switch is opened, and the safety protection device starts to work. The wireless transceiver module sends a request signal to an external device (such as a mobile phone, an IPAD or other intelligent terminal). After the request response is obtained, the trigger module triggers the safety switch, so that the electric heating wire can generate heat and lighting a cigarette. After the cigarette is lighted, the key is pulled down, and the switch is closed. Then, the safety protection device or the circuit is disconnected, and the lighter cannot be ignited at the moment.

Embodiment 2

Figure 4:
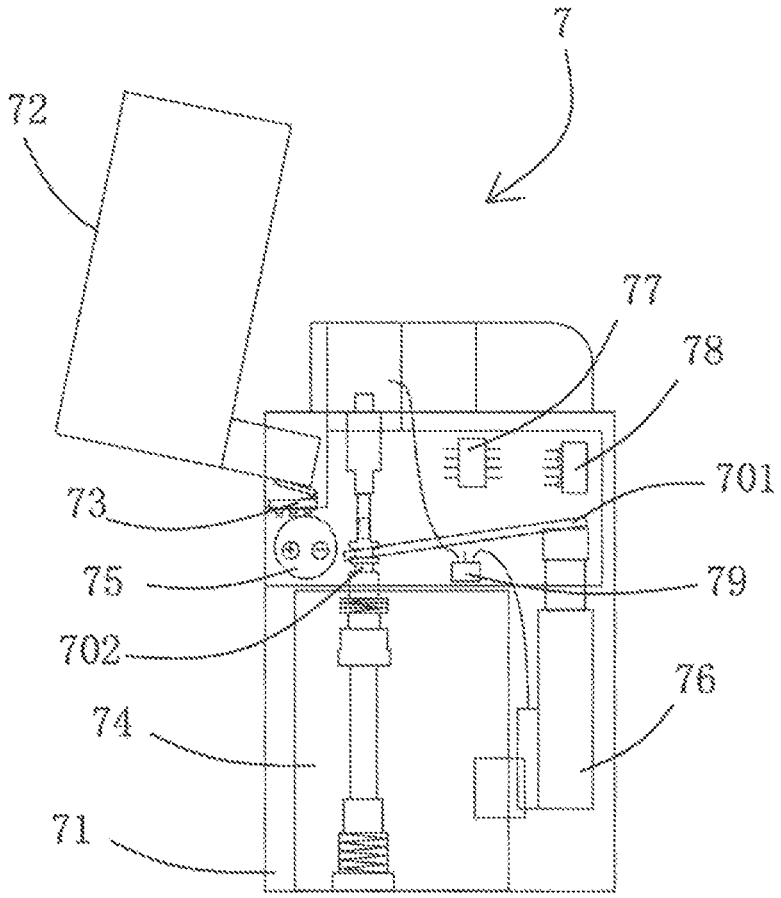
FIG. 4 is a schematic structural diagram of a lighter according to a second embodiment of the present invention.
Figure 7:
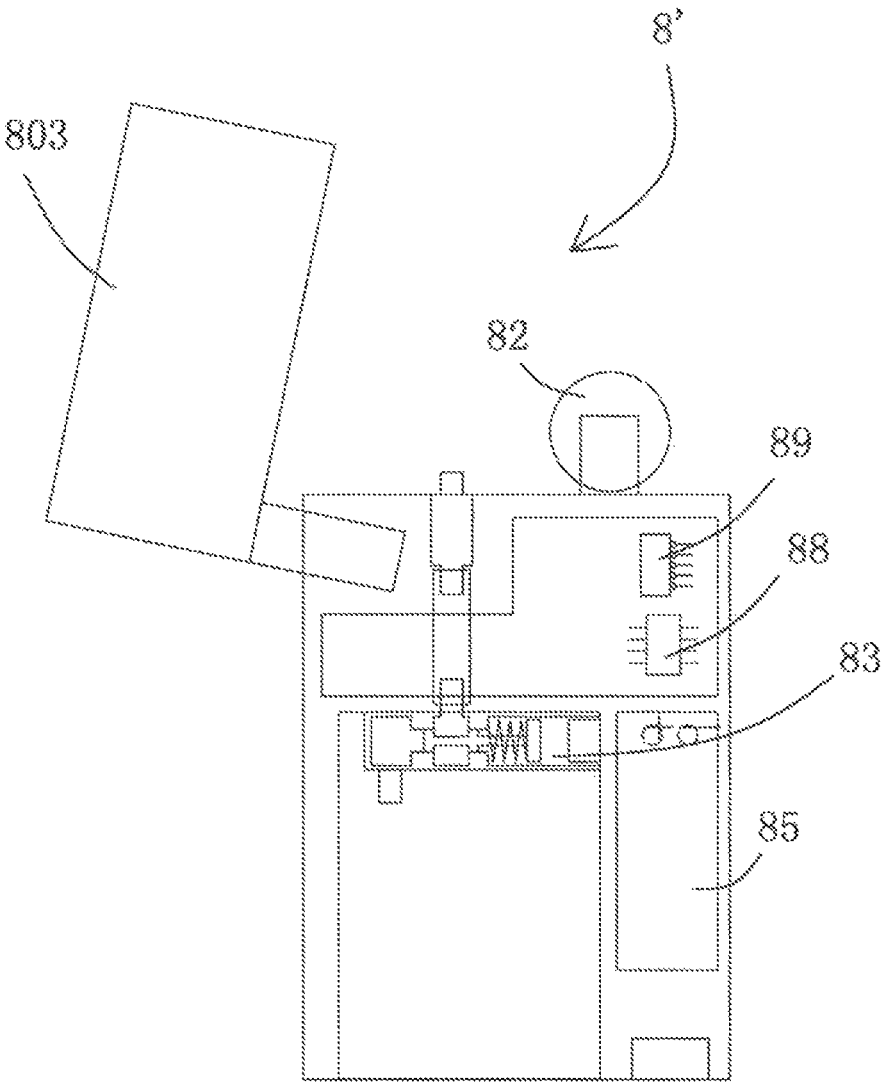
FIG. 7 is a schematic front view of a variation of the lighter of FIG. 5.

FIG. 4 illustrates a schematic structural diagram of a lighter 7 according to a second embodiment of the present invention. The lighter 7 is a gas piezoelectric voltage type lighter. As shown in FIG. 7, the lighter 7 comprises a shell 71, a lighter cover 72, an ignition switch 73, an air chamber 74, a battery 75, a trigger module 77, a piezoelectric voltage generating device 76, a wireless transceiver module 78 and a triode 79, wherein the trigger module 77, the wireless transceiver module 78 and the triode 79 form the safety protection device. The triode is used as the safety switch. The air chamber 74 is used for accommodating fuel. The fuel is, for example, butane, natural gas, alkane and the like.

The ignition switch 73 is cooperated with the lighter cover 72, so that the ignition switch 73 can be turned on when the lighter cover 72 is opened. The battery 75 is used for supplying power to the safety protection device. The trigger module 77 is in communication with the wireless transceiver module 78 and is electrically connected with the triode 79. The trigger module 77 can process signals from the wireless transceiver module 78 and send the processed signals to the triode 79 to enable or disable the piezoelectric voltage generating device 76.

The lighter 7 further comprises a jumping rod 701 and a gas valve 702. The gas valve 702 is used for opening the gas valve 702 so as to release gas in the gas tank.

Herein, the wireless transceiver module 78 may employ any suitable electronic element or integrated circuit which can transmit and receive signals, such as a bluetooth transceiver, a WIFI, a Lifi or an infrared transceiver. Preferably, the wireless transceiver module 78 can also process the signals.

Herein, the trigger module 77 can adopt any suitable electronic or mechanical device capable of controlling the triode.

During operation, the lighter cover 72 is opened and the ignition switch 73 are closed, and the safety protection device starts to work. The wireless transceiver module 78 transmits signals to the external devices (such as a mobile phone and an IPAD or other smart devices) and receives a response signal from the external device and transmits the signal to the trigger module 77. The trigger module 77 sends a signal to the triode 79 so as to control the passage of the triode 79. Then, the electronic clip is pressed down, so that the piezoelectric voltage generating device is switched on and drives the jumping rod 701, the gas valve 702 releases the fuel gas in the gas tank, so that ignition can be realized.

Embodiment 3

Figure 5:
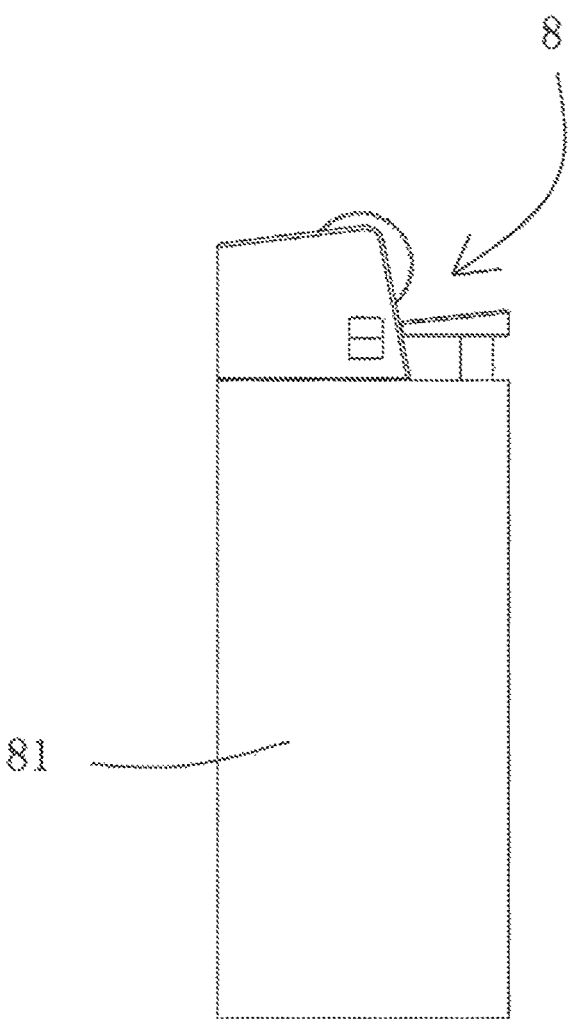
FIG. 5 is a schematic front view of a lighter according to a third embodiment of the present invention.
Figure 6:
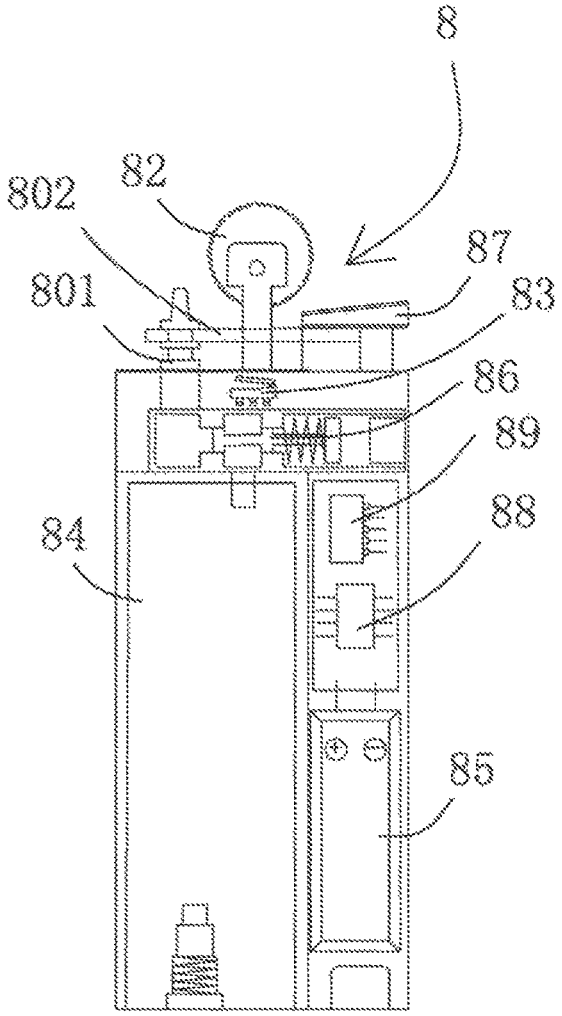
FIG. 6 is a schematic diagram showing an internal structure of the lighter of FIG. 5.
Figure 8:
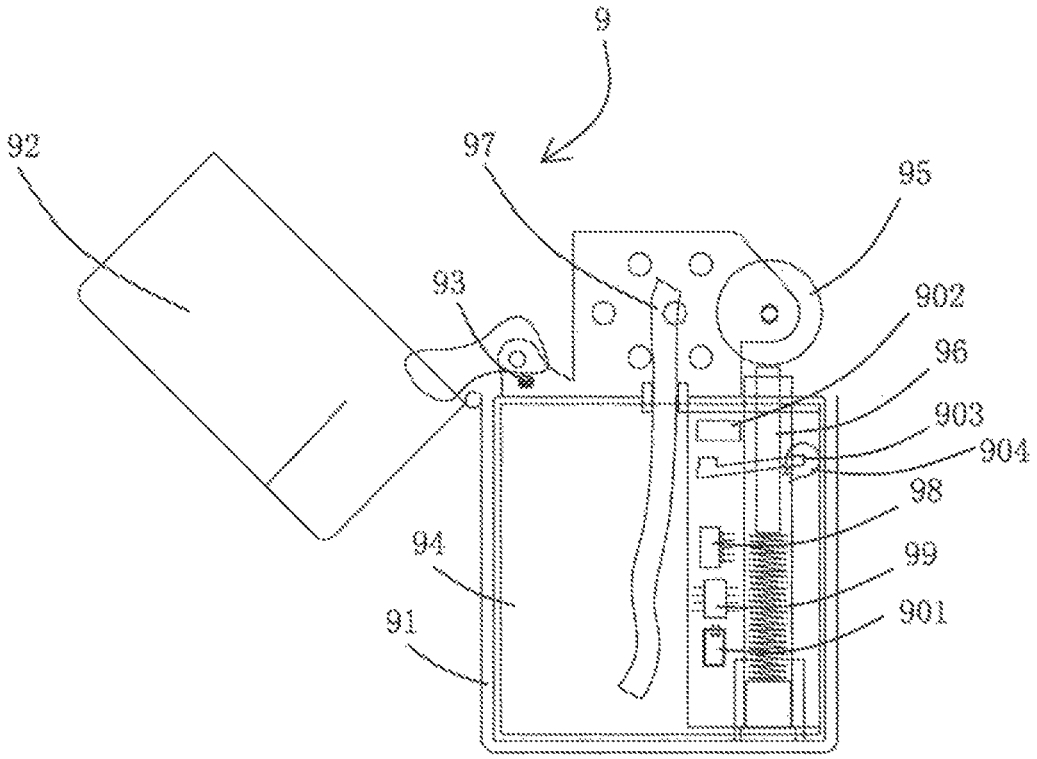
FIG. 8 is a schematic front view of a lighter according to a fourth embodiment of the present invention.

FIGS. 5 and 6 show schematic structural diagrams of the lighter 8 according to the third embodiment of the present invention. The lighter 8 is a gas grinding wheel lighter. As shown in FIG. 8, the lighter 8 comprises a shell 81, a grinding wheel assembly 82, an ignition switch 83, an air chamber 84, a battery 85, an solenoid valve 86, a button 87, a wireless transceiver module 88 and a trigger module 89, wherein the solenoid valve 86, the wireless transceiver module 88 and the trigger module 89 form the safety protection device. The solenoid valve serves as a safety switch. An inlet of the solenoid valve is communicated with the gas tank, and an outlet of the solenoid valve is communicated with the gas outlet valve 801. The gas outlet valve 801 is controlled by a connecting rod 802 connected with the button 87 to control the opening and closing. The air chamber 84 is used for containing fuel.

The ignition switch 83 is cooperated with the grinding wheel assembly 82, so that the ignition switch 83 can be turned on by the downward-pressing the grinding wheel. The battery 85 is used for supplying power to the safety protection device. The trigger module 89 is in communication with the wireless transceiver module 88 and is electrically connected with the solenoid valve 86. The trigger module 89 can process signals from the wireless transceiver module 88 and send the processed signals to the solenoid valve 86 to open or close the solenoid valve.

Herein, the wireless transceiver module 88 may employ any suitable electronic element or an integrated circuit which can transmit a signal and receive a signal, such as a bluetooth transceiver, a WIFI, a Lifi or an infrared transceiver. Preferably, the wireless transceiver module 88 can also process the signals.

The trigger module 89 can adopt any suitable electronic or mechanical device capable of controlling the solenoid valve.

During working, the grinding wheel is pressed and slid, the ignition switch 83 is turned on, and the safety protection device starts to work. The wireless transceiver module 88 transmits signals to external devices such as mobile phones, ipad and other intelligent devices. The wireless transceiver module 88 also receives a response signal from the external device and transmits the signal to the trigger module 89. The trigger module 89 sends a signal to the solenoid valve 86, so that the solenoid valve 86 is opened, and at the moment, the button 87 is pressed to drive the connecting rod 802, so that ignition can be realized.

FIG. 7 is a schematic front view of a variation of the lighter of FIG. 5. The embodiment is mainly different from the embodiment shown in FIG. 5 in that the lighter 8' of the embodiment further provide a cover 803. The operation of the safety protection device can be started by opening the cover 803. The rest is the same, and is not described in detail herein.

Embodiment 4

FIG. 8 shows a schematic structural diagram of a lighter 9 according to a third embodiment of the present invention, wherein the lighter 9 is a kerosene grinding wheel lighter. As shown in FIG. 8, the lighter 9 comprises a shell 91, a cover 92, an ignition switch 93, a liquid fuel containing chamber 94, a grinding wheel assembly 95, a flint 96, a wick (oil cotton) 97, a wireless transceiver module 98, a trigger module 99, a battery 901, an electromagnet 902, a jumping rod 903 and a locking member 904, wherein the electromagnet 902, the jumping rod 903 and the locking member 904 form a safety switch, wherein the safety switch, the wireless transceiver module 98 and the trigger module 99 form a safety protection device. The liquid fuel containing chamber 94 is used for containing fuel, and one end of the wick 97 extends into the liquid fuel containing chamber 94.

The jumping rod 903 is connected with the locking member 904. The locking member 904 is detachably connected to the flint 96. The trigger module 99 is in communication with the wireless transceiver module 98 and is electrically connected with the electromagnet 902. The battery 901 is used for supplying power to the safety protection device. The trigger module 99 can process signals from the wireless transceiver module 98 to enable the electromagnets to be powered on or powered off. When the wireless transceiver module receives a wireless response signal from an external device, the electromagnet 902 is electrified, and the electromagnet 902 actuates the jumping rod 903 and drives the locking member 904 to move, so that the flint is unlocked and is in contact with the grinding wheel, and at the moment, the rolling grinding wheel can achieve ignition.

Herein, the wireless transceiver module 98 may employ any suitable electronic element or an integrated circuit which can transmit a signal and receive a signal, such as a bluetooth transceiver, a WIFI, a Lifi or an infrared transceiver. Preferably, the wireless transceiver module 88 can also process the signals.

Herein, the trigger module 99 can adopt any electronic or mechanical device suitable for controlling power on/off of electromagnet. The fuel can be kerosene, methanol or ethanol.

During operation, the cover 92 is opened, the ignition switch 93 is turned on, and the safety protection device starts to work. The wireless transceiver module 98 sends signals to an external device such as mobile phone, ipad and other intelligent device, receives a response signal from the external device, and transmits the signal to the trigger module 99. The trigger module 99 enables the electromagnet to be powered on according to the received signal, so that the electromagnet drives the jumping rod 903 to move, so that the flint clay 96 is in contact with the grinding wheel, and at the moment, the rolling grinding wheel can achieve ignition.

In the embodiment, in a locked state, the grinding wheel is not in contact with the flint, and the ignition can not be realized even if the grinding wheel is operated.

Figure 9:
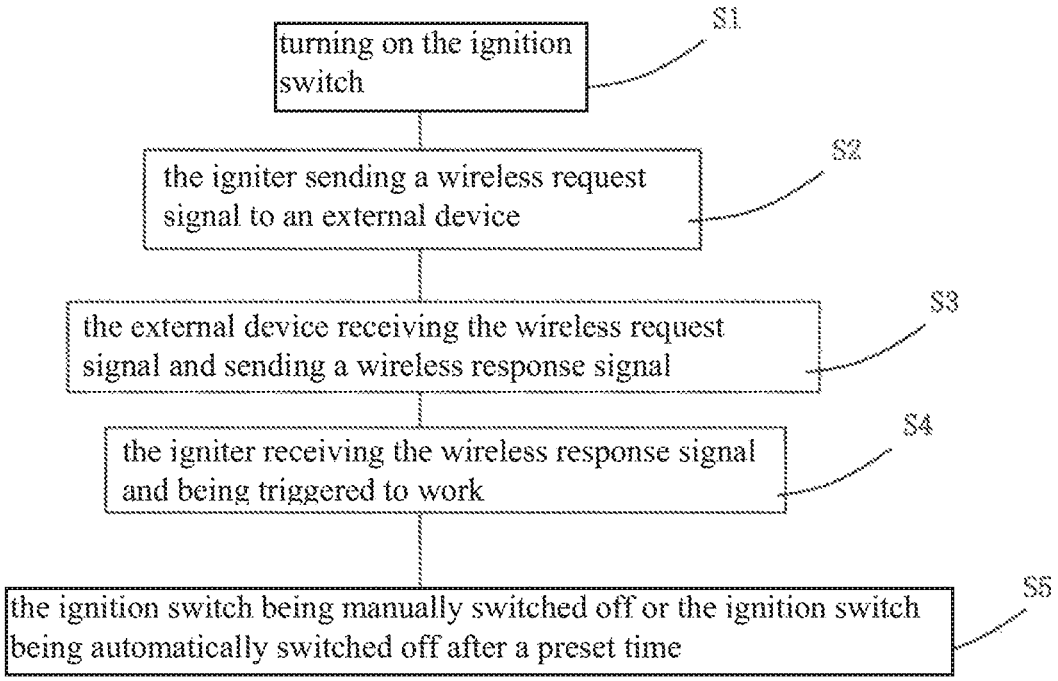
FIG. 9 shows an ignition control method for a lighter according to an embodiment of the present invention.

FIG. 9 illustrates an ignition control method for a lighter according to an embodiment of the present invention. As shown in FIG. 9, the ignition control method comprises the following steps:

turning on the ignition switch (S1);

the lighter sending a wireless request signal to an external device (S2);

the external device receiving the wireless request signal and sending a wireless response signal (S3);

the lighter receiving the wireless response signal and being triggered to work (S4);

the ignition switch being manually switched off or the ignition switch being automatically switched off after a preset period (S5).

In one embodiment, the ignition control method can be realized by the following steps:

downloading and installing an APP in the external device;

the lighter is communicated with the external device;

clicking an menu interface of the APP and clicking a cigarette lighting button;

the lighter receiving a signal sent by the external device and triggers the lighter, so that the lighter is in a state capable of being ignited, and the lighter is automatically disconnected after the preset period.

In another embodiment, the ignition control method can be realized by the following steps:

downloading and installing an APP in the external device;

arranging a gyroscope module in the lighter;

rocking and shaking the lighter such that the lighter is communicated to the external device, and the external device triggering the lighter to work through the APP after receiving a shaking signal of the lighter.

In yet another embodiment, the ignition control method can be realized by the following steps:

downloading and installing an APP in the external device such as a mobile phone or an IPAD;

turning on the bluetooths of the lighter and the external device both and the lighter being found;

clicking a menu interface of the APP and clicking a cigarette lighting button;

the lighter receiving the bluetooth signal and triggers the lighter, and the lighter being automatically disconnected after 5-10 seconds.

In yet another embodiment, the ignition control method can be implemented by the following steps:

downloading and installing an APP in an external devices such as a mobile phone and an IPAD;

pressing a volume key to directly unlock a screen, clicking a menu interface of the APP and clicking a cigarette lighting button;

the APP automatically running and simulating an incoming call and sends an electromagnetic wave signal, then the lighter receiving the signal and the lighter being triggered, wherein the lighter is automatically disconnected after 5-10 seconds.

In yet another embodiment, the ignition control method can be implemented by the following steps:

downloading and installing an APP in an external device such as a mobile phone and an IPAD;

clicking a menu interface of the APP and clicking a cigarette lighting button;

The APP automatically running and simulating an incoming call and sending an electromagnetic wave signal, then the lighter receiving the signal and the lighter being triggered, wherein the lighter is automatically disconnected after 5-10 seconds.

In yet another embodiment, the ignition control can be realized in a wired manner, and the specific steps are as follows:

downloading and installing an application APP based on an I/O port in external devices such as a mobile phone and an IPAD;

inserting the lighter is into the I/O port of the external device or using other means for communicating the external device to the lighter through the I/O port, and an APP menu interface being skipped out;

activating the mobile to input unlocking password by clicking the cigarette lighting key and after the unlocking password is input, a pulse signal being sent to the lighter to trigger the lighter to be ignited, and the lighter being automatically disconnected after 5-10 seconds.

The invention further provides an ignition control method of a lighter, comprising:

Turning on a portable intelligent terminal and installing an APP in it;

triggering a gyroscope module by continuously shaking the lighter for 3-5 seconds, and a bluetooth module and other wireless transceivers being activated to wait for communicating to the external device, or a built-in bluetooth module in the lighter ignition switch is actuated, and the lighter is immediately in a working state;

the APP guiding the user to define functions after the portable intelligent terminal is connected with the lighter through the bluetooth;

shaking the lighter again to trigger the gyroscope module to send signals to APP in the portable terminal through the bluetooth module;

the signals being returned to the intelligent control IC through the bluetooth module after the safety level defined by the user being confirmed by the APP in the portable terminal;

the intelligent control IC starting the coupling circuit to act on the heating control IC;

the heating control IC supplying power to the heating module to light a cigarette after the heating control IC works;

cutting off the current of the heating control IC after the heating module continuously heats for 5-10 seconds;

shaking the lighter again if another cigarette needs to be lighted after a cigarette was lighted.

In the ignition control method, the lighter cannot be used if there is no APP or corresponding external device, and therefore accidental injury cannot be caused.

In addition, the safety of the lighter of the invention can be further enhanced by setting the safety level. The security level can be set by the user through APP. For example, a child or an intelligent impaired person is considered to be high in safety level requirement. In this case, the mobile phone receives signals from the lighter to give an approval to the ignition request only when bluetooth and the screen saver of the mobile phone are activated. For an young single body, the requirement for the safety level is low. The method can be set as follows: the ignition request is approved when a signal from the lighter is received if the APP detects the bluetooth of the mobile phone.

The safety protection device is in a power-off state or a locked state when the lighter is in a normal state. The safety protection device is activated and the circuit of the lighter can work only when a trigger signal is input in a wired or wireless manner by an external device, so that a child or a disabled person can be prevented from accidentally using the lighter. Therefore, the probability of personal injury and property damage caused by the lighter is reduced.

Figure 10:
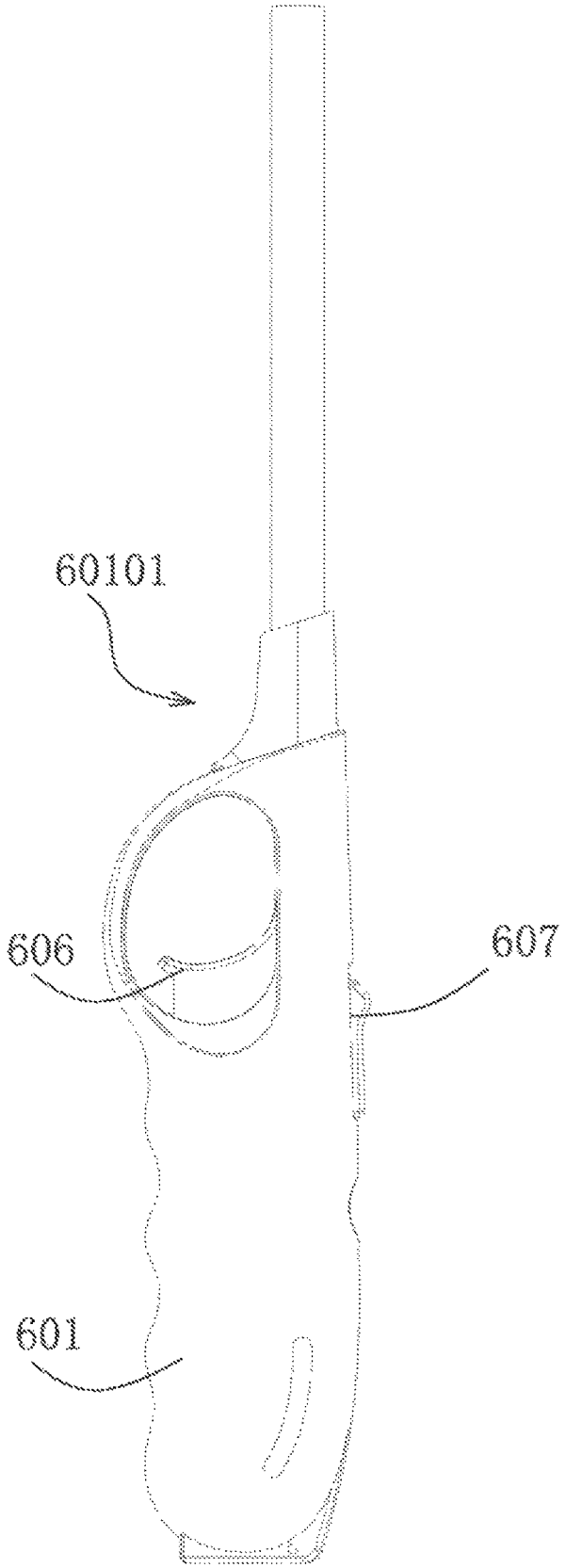
FIG. 10 is a front view of a schematic structure of a burning torch according to the first embodiment of the present invention.

FIG. 10 is the principle diagram of a burning torch 101 with a safety protection device according to the present application. The main principle of the anti-child safety protection function of the burning torch is that a split-type safety protection device is adopted, that is, the burning torch is triggered to work through another external device apart from the burning torch, and therefore safety protection is achieved. In other words, ignition cannot be realized if the burning torch does not receive an instruction or signal from the external device. The burning torch can be triggered to realize ignition only when the igniter itself sends out a request signal and receives a response signal from the external device, and therefore the safety protection function is achieved.

The external device can be a mobile terminal with a wireless transceiver. The wireless transceiver can receive a wireless request signal and send a wireless response signal based on the wireless request signal. Preferably, the mobile terminal is a smart phone, a tablet computer or a wearable device. The wearable device is, for example, a smart watch, a smart glasses or a smart bracelet.

As shown in FIG. 10, the burning torch 60101 comprises a body 601 and an gas outlet pipe 602. A gas tank 603 is contained in the body 601. the gas tank 603 is used for storing fuel gas and is used as an energy supply. The gas contained in the gas tank is, for example, butane, natural gas, alkane and the like. the gas tank 603 is connected with the gas outlet pipe 602 through a jumping rod 604. An ignition port 605 is formed at the tail end of the gas outlet pipe 602 and is adjacent to a spark generating end of the piezoelectric voltage generating device 608. When the piezoelectric voltage generating device 608 is pressed, the spark generating end emits a spark, so that the fuel gas is ignited.

The body 1 is further connected with an electronic clip 606 and a safety switch 607 (which can be referred to as a second safety switch). When the safety switch 607 is in the switch off position, the electronic clip 606 cannot be activated, when the safety switch 607 is in a turn on position, the electronic clip 606 can be activated to realize turning on or switching off. The safety switch 607 and the electronic clip 606 can adopt any appropriate structure known in the art to achieve the above functions.

A piezoelectric voltage generating device 608 and a gas releasing mechanism 609 are further arranged between the jumping rod 604 and the electronic clip 606, wherein the electronic clip 606 is connected with the piezoelectric voltage generating device 608, the piezoelectric voltage generating device 608 is connected with the gas releasing mechanism 609, and the gas releasing mechanism 609 is connected with the jumping rod 604. The action on the electronic clip 606 can drive the piezoelectric voltage generating device 608 to act, and drive the gas releasing mechanism 609 to act. The gas releasing mechanism 609 drives the jumping rod 604 to act to realize opening and closing of the gas tank 603.

The piezoelectric voltage generating device 608 can generate a voltage of up to 3000 v, which is mainly used for generating electric sparks, thereby igniting the gas. The piezoelectric voltage generating device 608 can be any appropriate element known in the art or to be developed.

The gas releasing mechanism 609 is mainly used for opening the gas tank to release gas to the gas outlet tube before the piezoelectric voltage generating device 608 generates an electric spark, so that gas in the gas tank can be introduced into the gas outlet tube. The gas releasing mechanism 609 can adopt any appropriate mechanism known in the art or to be developed.

In one variation, the gas releasing mechanism 609 may not be provided, and the piezoelectric voltage generating device directly drives the jumping rod to move, and then the gas tank is opened.

The gas outlet pipe 602 is divided into a first section of the gas outlet pipe 6021 and a second section of the gas outlet pipe 6022, wherein the first section of the gas outlet pipe 6021 is connected to the jumping rod 604, and the second section of the gas outlet pipe 6022 is connected to the ignition port 605. A safety switch 6013 (which can be referred to as a first safety switch) is arranged between the first section of the gas outlet pipe 6021 and the second section of the gas outlet pipe 6021. The safety switch 6013 can be switched on or off so as to turn off or turn on the fuel gas under the control of the control circuit. The safety switch 6013 can be composed of any suitable element such as an solenoid valve and the like.

It should be understood that the gas outlet tube 602 can also be a single tube. The safety switch 6013 is arranged at an inlet of the gas outlet tube 602 or on the jumping rod.

The control circuit is associated with the safety switch 607, so that when the safety switch 607 is switched on, the control circuit works. The control circuit comprises a wireless transceiver module 6011 and a control chip 6010. The wireless transceiver module 6011 is electrically connected with the control chip 6010. The control chip 6010 is electrically connected with the safety switch 6013. When the safety switch 607 is turned on, the control chip 6010 sends a wireless request signal to the external device via the wireless transceiver module 6011, and then receives a wireless response signal from the external device via the wireless transceiver module 6011. and whether the safety switch 6013 is triggered is determined according to the wireless response signal. If the wireless response signal is a signal allowing ignition, the control chip 6010 sends a command to control the safety switch 6013 to be turned on. If the wireless response signal is a signal not allowing ignition, or the control chip 6010 does not receive a wireless response signal, the control chip 6010 sends a command to control the safety switch 6013 to be turned off send a command to keep the safety switch 6013 in an turned off state.

Herein, the control chip 6010 serves as a trigger module for triggering the safety switch 6013. The control chip 6010 may be any suitable existing or to-be-developed integrated circuit or electronic device. The trigger module, the wireless transceiver module and the safety switch 6013 form an anti-child safety protection device of the burning torch together.

In one embodiment, the safety switch 6013 may be an solenoid valve connected in series to the gas outlet tube. In another embodiment, the safety switch 6013 can also be a control circuit board which can control the piezoelectric voltage generating device to be powered on or powered off according to the command of the control chip 6010.

Figure 12:
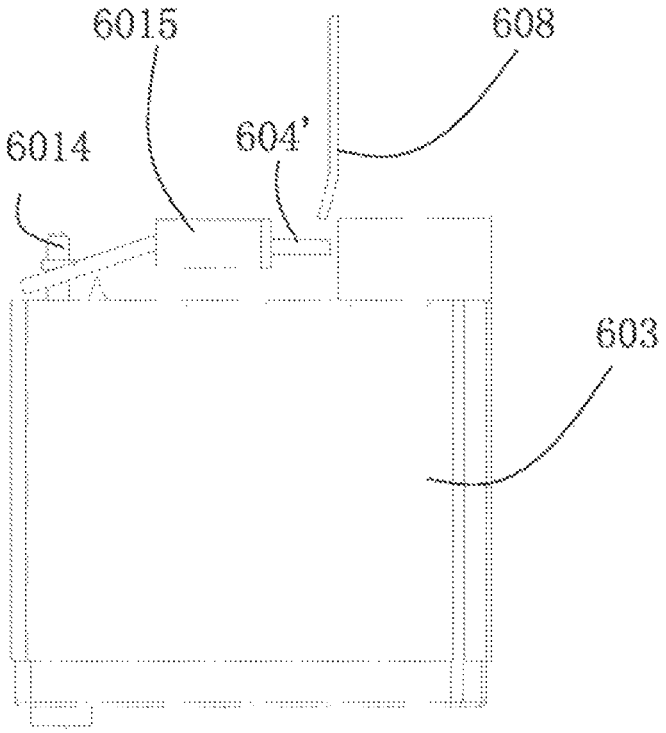
FIGS. 12 and 13 are schematic structural diagrams of a portion of the burning torch showing a safety control device, wherein the burning torch is respectively in an ignition state and an anti-ignition state.
Figure 13:
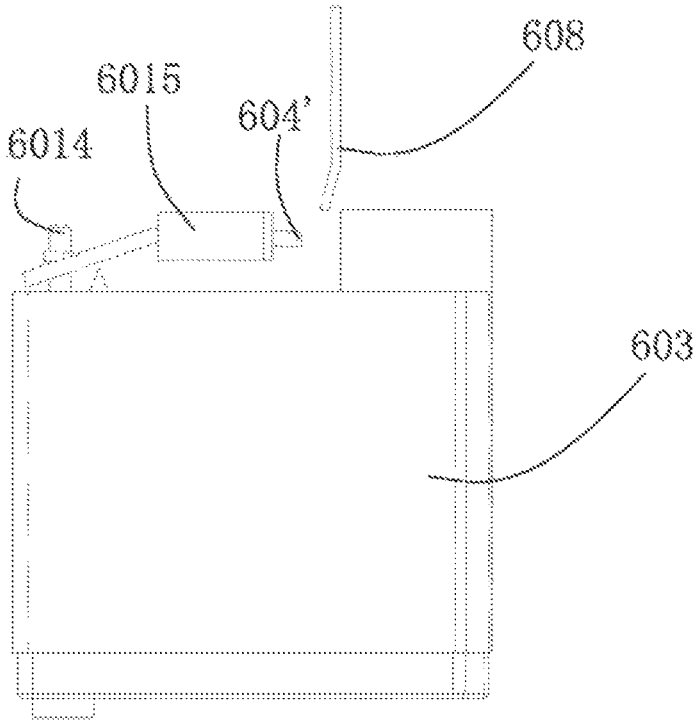

In one embodiment, safety control can be realized by controlling the jumping rod. As shown in FIGS. 12 and 13, the safety switch 6013 of the burning torch is a jumper assembly and comprises a jumping rod 604' and an electromagnetic controller 6015. The electromagnetic controller 6015 is connected with the jumping rod 604' and is used for controlling the jumping rod 604' to move. The jumping rod 604' is telescopic under the control of the electromagnetic controller 6015. When the electromagnetic controller 6015 receives a ignition command from the control chip 6010, the electromagnetic controller drives the jumping rod 604' to extend out of the electronic clip 608 and is positioned right below the electronic clip 608. Then, the electronic clip can be pressed to drive the jumping rod 604 to move, and then the gas outlet 6014 of the gas tank is opened, so that ignition is realized. When the electromagnetic controller 6015 does not receive an ignition command from the control chip 6010, the jumping rod 604' is retracted to (or held on) at a certain distance from the electronic clip 608. At this moment, the electronic clip cannot drive the jumping rod 604' to move even if the electronic clip is pressed down due to the electronic clip cannot be in contact with the jumping rod 604'. Therefore accidental ignition can be prevented.

The principle of the embodiment shown in FIGS. 12 and 13 is the control of the jumping rod, so that the jumping rod can be switched between a first position and a second position. When no ignition command is received, the jumping rod is located at the first position, the electronic clip cannot be in contact with the jumping rod, and then ignition is prevented. When an ignition command is received, the jumping rod is in the second position, and the ignition is achieved. It should be understood that the above principle can be realized by adopting any suitable solution comprising the above solution.

Figure 11:
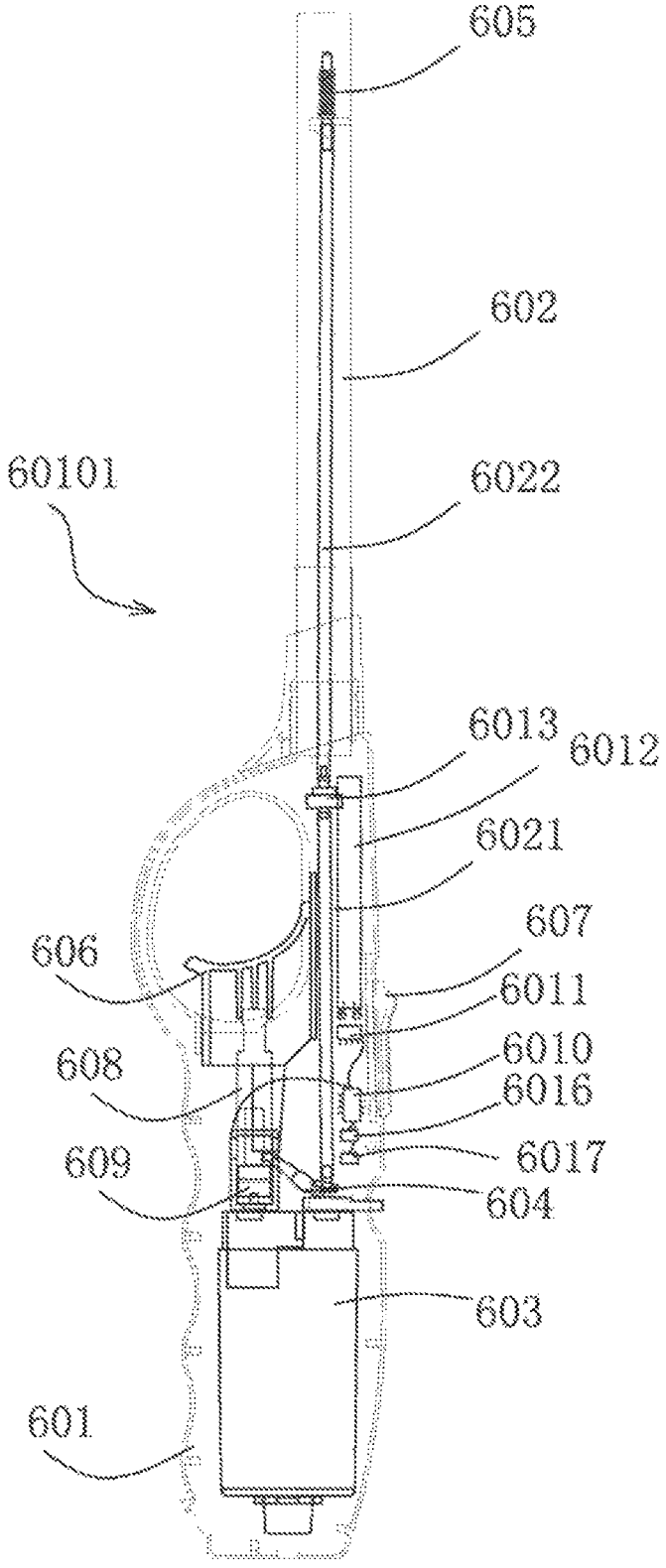
FIG. 11 is a schematic diagram showing an internal structure of the burning torch of FIG. 10.

In one embodiment, the burning torch can further comprise a data acquisition module 6016 and a memory 6017, as shown in FIG. 11. The data acquisition module 6016 is in communication with the control chip 6010, and is used for collecting and recording ignition data, such as ignition times, ignition positions, ignition time and the like. The memory 6017 is in communication with the data acquisition module 6016 and is used for storing the ignition data. The user can know where people are get together to barbecue through the data, so that the places for barbecue can be shared, and fire warning and the like of the places for barbecue can be controlled. The data acquisition module 6016 is a module capable of acquiring data from related signals, and any appropriate module known in the art or to be developed can be adopted. Preferably, the data acquisition module 6016 is associated with the electronic clip 606, so as to collect data related to the action of the electronic clip and serve as ignition data.

These ignition data may be transmitted to external devices via wired means such as USB interfaces. The data acquisition module 6016 can also be electrically connected with the wireless transceiver module, so that the ignition data can be transmitted to external devices or a network through the wireless transceiver.

Herein, the wireless transceiver module 6011 comprises a bluetooth transceiver, Wifi, Zegbee, Lifi or infrared transceivers and the like.

Herein, the burning torch 60101 can also be provided with a battery 6012, a charging port, a USB port, a power indicator and a gas adjusting switch, wherein the battery 6012 is contained in the body and is used for supplying power to the control circuit. The charging port is arranged on the body and is used for charging the battery. The power indicator is arranged on the body and is used for indicating the electric quantity of the battery. The gas adjusting switch is used for adjusting the amount of gas out from the gas tank, so that the flame is controlled.

During operation, the safety switch 607 is switched on. The control chip 6010 is powered on and sends a wireless request signal to the external device via the wireless transceiver module 6011. Then, The control chip 6010 receives a wireless response signal from the external device via the wireless transceiver module 6011 and determines whether the safety switch 6013 is triggered according to the wireless response signal. If the wireless response signal is a signal allowing ignition, the control chip 6010 sends a command to control the safety switch 6013 to turn on. At this moment, the electronic clip 606 is pressed, the electronic clip 606 drives the jumping rod 604 to move through the piezoelectric voltage generating device 608 and the gas releasing mechanism 609, so that the gas is conveyed from the gas tank 603 to the gas outlet pipe 602. Meanwhile, the piezoelectric voltage generating device 608 works to generate sparks to realize ignition. If the wireless response signal is a signal not allowing ignition or the control chip 6010 does not receive a wireless response signal, the control chip 6010 sends a command to control the safety switch 6013 to be switched off or does not send a command so as to keep the safety switch 6013 in a switch off state. At the moment, even if the electronic clip 606 is pressed, ignition can not be realized.

Herein, the burning torch comprises various types of burning torches for igniting cigarettes, tobacco pipes, barbecue ovens or fireplace.

In one variation, the burning torch can not be provided with the safety switch 607 and only the safety switch 6013 is arranged. at this time, when the burning torch works, the burning torch detects and communicates with external device in a wireless transceiver module (such as bluetooth), and after receiving the instruction of the external device, the electronic clip can be pressed to realize ignition, and when the electronic clip is in a wireless transceiver module (such as bluetooth) when no external device is detected or the external device is not in communication with the external device, the ignition can not be realized even if the electronic clip is pressed.

Figure 14:
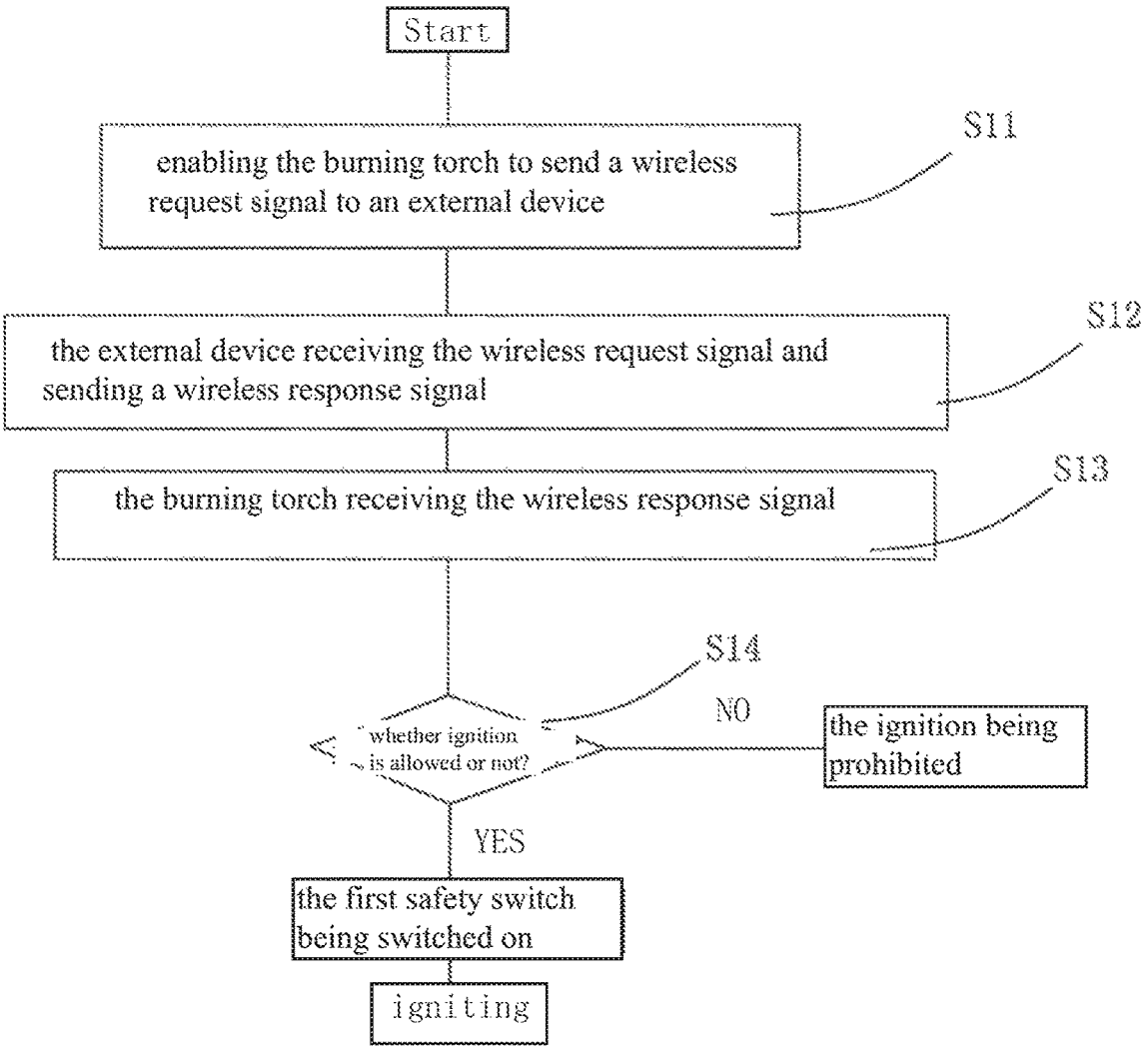
FIG. 14 shows a flow chart of an embodiment of an ignition control method for a burning torch.

FIG. 14 shows a control flow diagram of an embodiment of an ignition control method for a burning torch according to the present invention. The ignition control method of the burning torch comprises the step S1: judging whether the burning torch is in communication with an external device, wherein if the burning torch is not in communication with the external device, forbidding ignition of the burning torch, and if the burning torch is in communication with the external device, the burning torch directly ignite or the burning torch determines whether ignition is allowed according to an instruction from the external device.

In one embodiment, as shown in FIG. 14, the ignition control method can include the following steps:

S11, enabling the burning torch to send a wireless request signal to an external device;

S12, the external device receiving the wireless request signal and sending a wireless response signal;

S13, the burning torch receiving the wireless response signal;

S14, the burning torch judging whether the received wireless response signal is a signal allowing ignition, if yes, the first safety switch being switched on, and ignition being realized; if not, the ignition being prohibited.

The steps S11 and S12 can be realized, for example, by pressing the electronic clip so that the burning torch is in communication with external device. Alternatively, when the safety switch 607 is arranged, the burning torch can be directly communicated with the external device after the safety switch 607 is switched on, and the burning torch can also be in communication with external device by pressing the electronic clip after the safety switch 607 is connected.

In the step S13, after the burning torch receives a wireless response signal of the external device, the burning torch judges whether the signal is a signal allowing ignition, and if the signal is the signal allowing ignition, ignition is realized, and if not, ignition cannot be realized.

In one variation, the burning torch may be configured to detect a matched external device, ignition can be realized, and if the matched external device is not detected, ignition cannot be realized.

Specifically, the ignition control of the burning torch can include the following three cases.

Case 1: at first connection, an app and a Bluetooth of the external device is actuated, the electronic clip of the burning torch is pressed down (when a safety switch 607 is arranged, the safety switch 607 is started at the moment; alternatively, the safety switch 7 can be omitted, and a bluetooth circuit can be started, so that the bluetooth is in a waiting connection state within 30 seconds or within 1 minute). Then, the electronic clip is loosened, and the external device is connected with the burning torch. After being connected and licensed, and the burning torch is ignited when the electronic clip is pressed again, and the data is recorded and returned to the external device. The flame is extinguished when the electronic clip is loosened.

Case 2: if an ignition is carried out again within a short predetermined time, for example, 5 minutes or 10 minutes after the first ignition is completed, the burning torch is ignited when the electronic clip of the burning torch is pressed since the bluetooth is connected with external device (the bluetooth can be set so that the external device is continuously connected with the bluetooth during a certain time after each ignition is finished). Theoretically, instant ignition can be realized without waiting, but in fact, there may be a 0.5-1 second delay due to the circuit board and the switch response. The data is recorded and returned to the external device. The flame is extinguished when the electronic clip is loosened.

Case 3: if an ignition interval is longer than a longer preset period, such as 5 minutes or 10 minutes, the bluetooth circuit of the burning torch is in a dormant state at the moment (the bluetooth is dormant if there is no operation in a preset period which can be achieved by setting a continuous connection time of the bluetooth). At this time, the bluetooth circuit of the burning torch quit the dormant state when the electronic clip is pressed and an ignition request is sent to the external device (due to the fact that the bluetooth connection has memory, there is no need to connect again)). When a signal allowing ignition from the external device is returned to the bluetooth burning torch, the burning torch realizes ignition (theoretically, it take less 0.5 seconds from sending a request by a bluetooth to obtaining a response. In fact, due to the position of the external device and the burning torch as well as the signal delay and other situations, it may take more than 0.5 seconds to get response, for example, a response can be obtained within 2 seconds, and the data is recorded and returned to the external device. The flame is extinguished when the electronic clip is loosened.

In the case 1, in the first connection, the burning torch can also be arranged to be in a connection state with external device after the burning torch electronic clip is pressed for a preset period, and if the electronic clip continues to be pressed, the ignition is realized. In other words, when igniting first time, the electronic clip is not required to be loosened firstly, and then the electronic clip is pressed again.

In the three cases, the external device can be a smart phone or other portable device and wearable device. A wireless transceiver and an app can be installed on the device. In the three cases, a bluetooth is used as a wireless transceiver as an example. It should be understood that a wireless transceiver such as WIFI, Zegbee, Lifi or an infrared transceiver can also be adopted.

In the ignition control method, the external device can install an app for controlling the communication of the external device with the burning torch. The step S1 comprises starting the app before the step S11. The burning torch can be set such that when the burning torch and the external device are separated by a preset distance or the APP stops running, the burning torch cannot realize ignition.

In one embodiment, the ignition control method can be implemented by the following steps:

downloading and installing an APP in the external device;

clicking the menu of the APP and clicking a cigarette lighting button;

pressing the electronic clip of the burning torch, and the burning torch and the external device being in communication;

the burning torch receiving a signal sent by external device and triggering the burning torch, so that the burning torch is in a state capable of igniting the ignition, and automatically disconnecting after a preset period.

In another embodiment, the ignition control method can be realized by the following steps:

downloading and installing an APP in the external device;

arranging a gyroscope module in the burning torch;

rocking and shaking the burning torch such that the burning torch is communicated to the external device, and the external device triggering the burning torch to work through the APP after receiving a shaking signal of the burning torch.

In yet another embodiment, the ignition control method can be realized by the following steps:

downloading and installing an APP in the external device such as a mobile phone or an IPAD;

turning on the bluetooths of the burning torch and the external device, and finding the burning torch;

clicking a menu interface of the APP and clicking a cigarette lighting button;

the burning torch receiving a bluetooth signal and triggering the burning torch, and the burning torch being automatically disconnected after 5-10 seconds.

In yet another embodiment, the ignition control method can be implemented by the following steps:

downloading and installing an APP in an external device such as a mobile phone and an IPAD;

pressing a volume key to directly unlock a screen, clicking a menu interface of the APP and clicking a cigarette lighting button;

the APP automatically running and simulating an incoming call and sending an electromagnetic wave signal, then the burning torch receiving the signal and the burning torch being triggered, the burning torch being automatically disconnected after 5-10 seconds.

In yet another embodiment, the ignition control method can be implemented by the following steps:

downloading and installing an APP in an external device such as a mobile phone and an IPAD;

clicking a menu interface of the APP and clicking a cigarette lighting button;

the APP automatically running and simulating an incoming call and sending an electromagnetic wave signal, then the burning torch receiving the signal and the burning torch being triggered, the burning torch being automatically disconnected after 5-10 seconds.

In yet another embodiment, the ignition control can be realized in a wired manner, and the specific steps are as follows:

downloading and installing an application APP through an I/O port in an external device such as a mobile phone and an IPAD;

inserting the burning torch into the I/O port of the external device or using other means for communicating the external device to the burning torch through the I/O port, and an APP menu interface being skipped out;

activating the mobile and inputting unlocking password by clicking the cigarette lighting key and after the unlocking password is input, a pulse signal being sent to the burning torch to trigger the burning torch to be ignited, and the burning torch being automatically disconnected after 5-10 seconds.

The invention further provides an ignition control method of a burning torch, comprising:

turning on a portable intelligent terminal and installing an APP in it;

triggering a gyroscope module by continuously shaking the burning torch for 3-5 seconds, and activating a bluetooth module and other wireless transceivers to wait for communicating to the external device, or actuating a built-in bluetooth module in the burning torch ignition switch, and the burning torch being immediately in a working state;

the APP guiding the user to define functions after the portable intelligent terminal is connected with the burning torch through the bluetooth;

shaking the burning torch again to trigger the gyroscope module to send signals to APP in the portable terminal through the bluetooth module;

returning the signals to the intelligent control IC through the bluetooth module after the safety level defined by the user are confirmed by the APP in the portable terminal;

starting the safety switch by the intelligent control IC, so that the burning torch is in a normal working state.

In the ignition control method, the lighter cannot be used if there is no APP or corresponding external device, and therefore accidental injury cannot be caused.

The preferred embodiments of the present invention have been described in detail above. However, it should be understood that after reading the teachings of the present invention, a person skilled in the field can make various modifications or modifications to the invention. These equivalent forms are also within the scope defined by the appended claims.

The invention claimed is:

1. A lighter with a safety protection device, wherein the lighter comprises an ignition switch and an energy supply module, wherein the safety protection device comprises a safety switch, a trigger module and a wireless transceiver module, wherein the wireless transceiver module is capable of transmitting a wireless request signal, receiving a wireless response signal from an external device and transmitting the received wireless response signal to the trigger module, wherein the trigger module triggers the safety switch according to the wireless response signal to enable the safety switch to act so that ignition can be realized, and the ignition cannot be realized even the ignition switch is actuated when the wireless transceiver module does not receive the wireless response signal.

2. The lighter according to claim 1, wherein the external device is a mobile terminal with a wireless transceiver, wherein the wireless transceiver is capable of receiving the wireless request signal and sending the wireless response signal according to the wireless request signal.

3. The lighter according to claim 2, wherein the mobile terminal is a mobile phone, a tablet computer or wearable device.

4. The lighter according to claim 1, wherein the lighter is provided with an auxiliary battery, and the auxiliary battery supplies power to the safety protection device.

5. The lighter according to claim 1, wherein the wireless transceiver module comprises a bluetooth transceiver, Wifi, Lifi, a Zigbee or an infrared transceiver.

6. The lighter according to claim 1, wherein the lighter further comprises a grinding wheel and a flint, the energy supply module being provided with a gas tank used for containing liquefied fuel, wherein the safety switch is a valve arranged at the outlet of the gas tank and is used for opening or closing the gas tank, wherein the trigger module is in communication with the wireless transceiver module and is electrically connected with the safety switch, wherein the trigger module is capable of processing signal from the wireless transceiver module and sending the processed signal to the valve to open the valve.

7. The lighter according to claim 6, wherein the valve is an solenoid valve.

8. The lighter according to claim 1, wherein the lighter further comprises a piezoelectric voltage generating device, and the energy supply module is provided with a gas tank used for containing the liquefied fuel, wherein the piezoelectric voltage generating device is electrically connected with the safety switch, wherein the trigger module is in communication with the wireless transceiver module and is electrically connected with the safety switch, wherein the trigger module processes signals from the wireless transceiver module and sends the processed signals to the safety switch to enable the safety switch to be switched on, and further enables the piezoelectric voltage generating device to work.

9. The lighter according to claim 8, wherein the safety switch is a triode, a controllable air switch or a microswitch.

10. The lighter according to claim 1, wherein the energy supply module is a battery, and the battery is electrically connected with the heating wire via the safety switch, wherein the trigger module is in communication with the wireless transceiver module and is electrically connected with the safety switch, wherein the trigger module is capable of processing signals from the wireless transceiver module and sending the processed signals to the safety switch to enable the battery to be connected with or disconnected from the heating wire.

11. The lighter according to claim 1, wherein the lighter further comprises a grinding wheel, a wick and a flint, and the energy supply module is provided with a liquid fuel containing chamber, wherein one end of the wick extends into the liquid fuel containing chamber, wherein the trigger module is in communication with the wireless transceiver module and is electrically connected with the safety switch, wherein the trigger module is capable of processing signals from the wireless transceiver module and sending the processed signals to the safety switch so as to lock or unlock the flint, wherein, in an unlocked state, when the grinding wheel is operated, a spark will be generated such that the ignition is realized, and in the locked state, the ignition can not be realized even when the grinding wheel is operated.

12. The lighter according to claim 11, wherein the safety switch comprises an electromagnet, a jumping rod and a locking member, wherein the jumping rod is connected with the locking member, and the locking member is detachably connected to the flint, wherein when the wireless transceiver module receives a wireless response signal from the external device, the jumping rod is actuated by the electromagnet and the locking member is driven to move, so that the flint is unlocked and is in contact with the grinding wheel.

13. An ignition control method of a lighter comprising an ignition switch and an energy supply module, and the control method comprises the following steps:

closing the ignition switch;

sending a wireless request signal to an external device by the lighter;

the external device receiving the wireless request signals and sending out a wireless response signal;

the lighter receiving the wireless response signal and being triggered to work;

the ignition switch being switched off automatically after a preset period or being switched off manually.

14. The method according to claim 13, wherein the method comprises a step of arranging a safety switch, a trigger module and a wireless transceiver module in the lighter, wherein the wireless transceiver module is capable of transmitting a wireless request signal, receiving a wireless response signal from the external device and transmitting the received wireless response signal to the trigger module, wherein the trigger module triggers the safety switch to enable the safety switch to act according to the wireless response signal, so that the ignition switch is capable of achieving ignition, and when the wireless transceiver module does not receive the wireless response signal, the safety switch does not act, and ignition can not be realized even if the ignition switch is actuated.

15. The method according to claim 13, wherein the external device is a mobile terminal with a wireless transceiver, and the wireless transceiver is capable of receiving the wireless request signal and sending the wireless response signal according to the wireless request signal.

16. The method according to claim 15, wherein the mobile terminal is a mobile phone, a tablet computer or a wearable device.

17. The method according to claim 13, wherein the method comprises the following steps:

downloading and installing an APP in the external device;

communicating the lighter with the external device;

clicking the menu of the APP and clicking a cigarette lighter button;

the lighter receiving a signal sent by the external device and being triggered, so that the lighter is in a state capable of being ignited and the lighter is automatically switched off after the preset period.

18. An ignition control method of a lighter comprising an ignition switch and an energy supply module, wherein the ignition control method comprises the following steps: judging whether the lighter is in communication with a external device, and if the lighter is not in communication with the external device, the lighter is prohibited from being ignited, and if the lighter is in communication with the external device, the lighter is directly ignited or the lighter determines whether ignition is allowed according to an instruction from the external device.

* * * * *